10/22/35 OF 4,548,388

United States Patent [19]

Cobler

[11] Patent Number: 4,548,388

[45] Date of Patent: Oct. 22, 1985

[54] FENCE PROTECTOR

[76] Inventor: Larry L. Cobler, 1812 N. Filmore, Topeka, Kans. 66608

[21] Appl. No.: 678,637

[22] Filed: Dec. 6, 1984

[51] Int. Cl.[4] ..... E04H 17/06

[52] U.S. Cl. ..... 256/32; 256/1

[58] Field of Search ..... 256/1, 32; 47/33; 29/526 R

[56] References Cited

U.S. PATENT DOCUMENTS

| | | | |
|---|---|---|---|
| 2,826,393 | 3/1958 | Miller | 256/19 |
| 3,384,351 | 5/1968 | Turner, Jr. | 256/32 |
| 3,393,897 | 7/1968 | Wright | 256/32 |
| 3,515,373 | 6/1970 | Abbe | 256/32 |
| 3,545,127 | 12/1970 | Jensen | 47/33 |
| 3,619,944 | 11/1971 | Matvey | 47/33 |
| 3,704,004 | 11/1972 | Carter, Jr. | 256/59 |
| 3,713,624 | 1/1973 | Niemann | 256/32 |
| 3,768,780 | 10/1973 | Cowles et al. | 256/32 |
| 3,806,096 | 4/1974 | Eccleston et al. | 256/32 |
| 3,822,864 | 7/1974 | Keys | 256/32 |
| 3,945,747 | 3/1976 | Cruz | 404/7 |
| 4,349,989 | 9/1982 | Snider, Jr. | 47/33 |
| 4,478,391 | 10/1984 | Korach | 256/32 X |
| 4,497,472 | 2/1985 | Johnson | 256/1 X |

*Primary Examiner*—Andrew V. Kundrat

*Attorney, Agent, or Firm*—D. A. N. Chase; Michael Yakimo, Jr.

[57] ABSTRACT

A fence protector comprising first and second panel members each having a vertical and horizontal leg therein. The vertical legs are placed on opposed sides of the bottom of a fence line with a strip of insulation material being initially interposed between the fence line and a vertical leg of one of the panels. Upon drawing the panels one towards the other by a bolt/nut combination or clamping device, a channel, filled with the insulation material, is presented with the bottom of the fence line contained therein. The insulation-filled channel precludes the entry of growth-enhancing elements into the channel and growth of vegetation therein.

7 Claims, 8 Drawing Figures

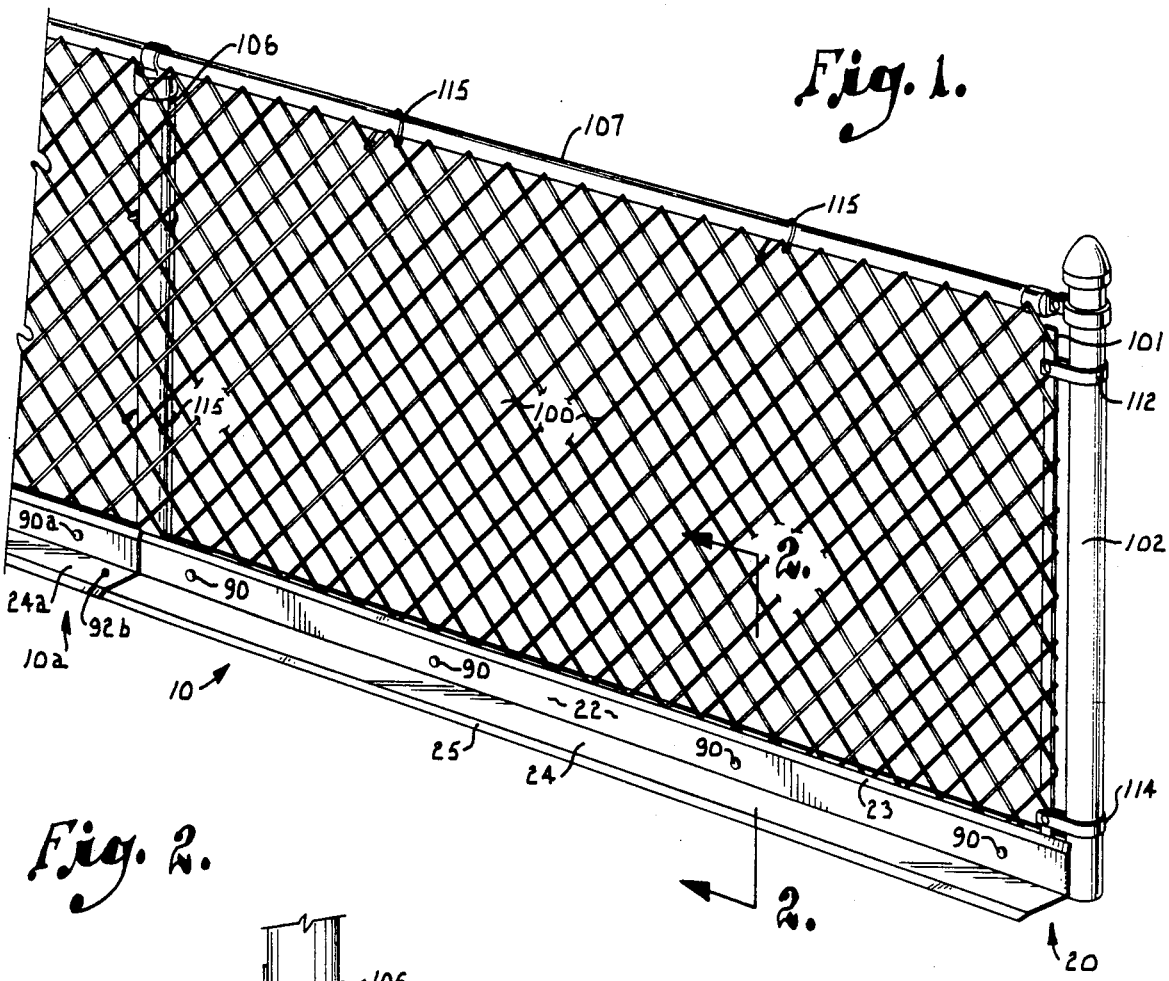
Fig. 1.
Fig. 2.
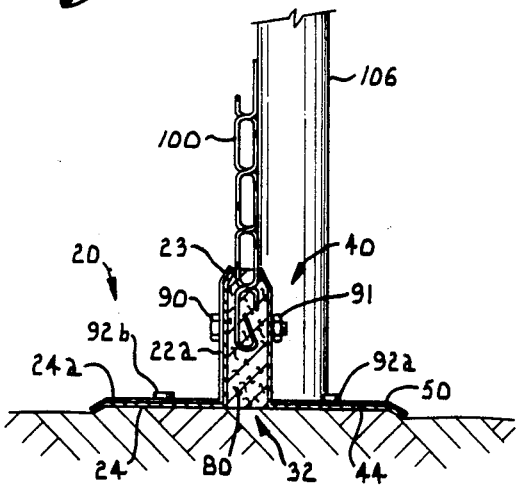
Fig. 3.
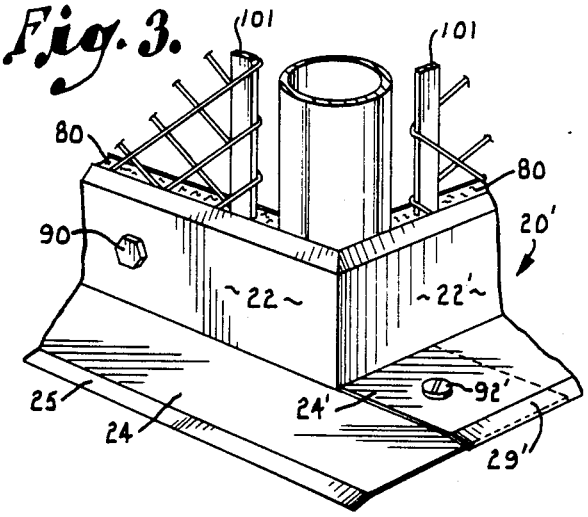
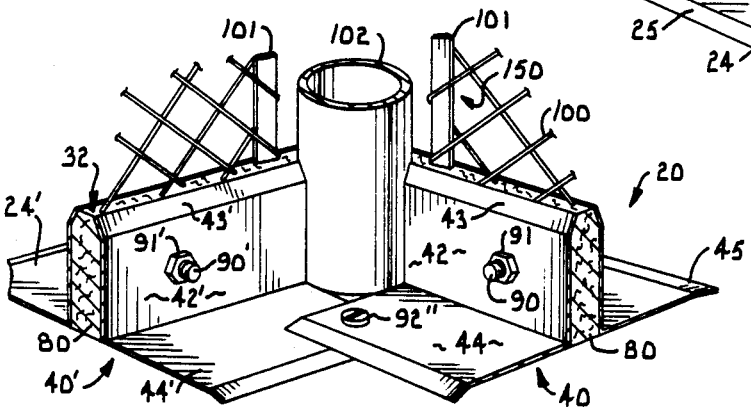
Fig. 4.

FENCE PROTECTOR

BACKGROUND OF THE INVENTION

This invention relates to an improved fence guard for restricting the growth of grass, weeds and the like directly adjacent to or beneath a fence line.

Past fence guards have utilized first and second elongated panels generally L-shaped in cross-section. The vertical leg of each panel abuts the opposed sides of the fence with the horizontal leg extending from the bottom of the vertical leg and along the ground. The vertical legs protect the lower portion of the fence while the horizontal legs preclude the growth of any grass, weeds, etc. adjacent the fence line.

Although such fence guards are assumably effective in their operation, a problem has arisen in that weeds grow in the channel presented between the first and second vertical legs. The removal of such weeds is difficult as it is hindered by the bottom of the fence protruding into the channel.

Various solutions have been suggested to address this problem including the use of various types of permanent barriers installed underneath the fence line to preclude the appearance of vegetation therealong. Other growth-impeding devices have included the use of specially designed panel members which present a barrier underneath the line upon intraengagement of the panel members.

As the bottom of preexisting fences normally contact the ground, past devices are not easily adaptable for installation to fences already in place. Also vegetation along preexisting fence lines further inhibits the installation of such devices therebelow. Thus, past devices have increased the costs and complexity of manufacture and/or installation.

In response thereto I have invented an improved fence guard which utilizes first and second L-shaped panel members having vertical and horizontal leg members therein. The vertical leg of each panel is positioned on opposed sides of the fence with the bottom edge of the fence being positioned in a channel presented therebetween. Prior to connection of the first panel to the second panel by means of nuts, bolts, clips etc., a strip of batt insulation is placed between the bottom edge of the fence and the vertical leg of one of the panel members. Upon connection of the panels, the insulation is compressed between the panel and the fences. This compression urges the insulation material through the open portions/interstices of the adjacent fence for contact with the interior face of the vertical leg of the opposed panel. The insulation material fills the resulting channel which precludes entry of moisture and/or sunlight on the ground beneath the fence line. Thus, the undesirable growth of vegetation between the panels and below the fence line is inhibited. The novel use of the compressible insulation material allows my fence guard to be easily installed on existing fence lines and eliminates the need to utilize relatively complex fence guards and the resulting labor costs.

Accordingly, it is an object of the present invention to provide an improved fence guard for restraining the growth of grass, weeds and the like directly underneath and adjacent a fence line.

Another object of this invention is to provide a fence guard, as aforesaid, which utilizes a compressible filler material to preclude the growth of vegetation along the fence line.

A still further object of this invention is to provide a fence guard with compressible material, as aforesaid, which fills the interstices of a chain link fence so as to preclude the growth of vegetation along the ground-adjacent fence line.

Another object of this invention is to provide a fence guard which can be inexpensively installed on existing or new fences.

Other objects and advantages of this invention will become apparent from the following description taken in connection with the accompanying drawings, wherein is set forth by way of illustration and example, an embodiment of this invention.

BRIEF DESCRIPTION OF THE DRAWINGS

FIG. 1 is a perspective view of a straight run of a fence line with the fence protector in place;

FIG. 2 is a section view, taken along line 2—2 in FIG. 1, showing the relationship among the elements of the fence protector;

FIG. 3 is a perspective view of the fence protector adapted to fit about an outside corner of a fence line;

FIG. 4 is a perspective view of the fence protector adapted to fit about the inside corner of the fence in FIG. 3;

DESCRIPTION OF THE PREFERRED EMBODIMENT

Figure 7:
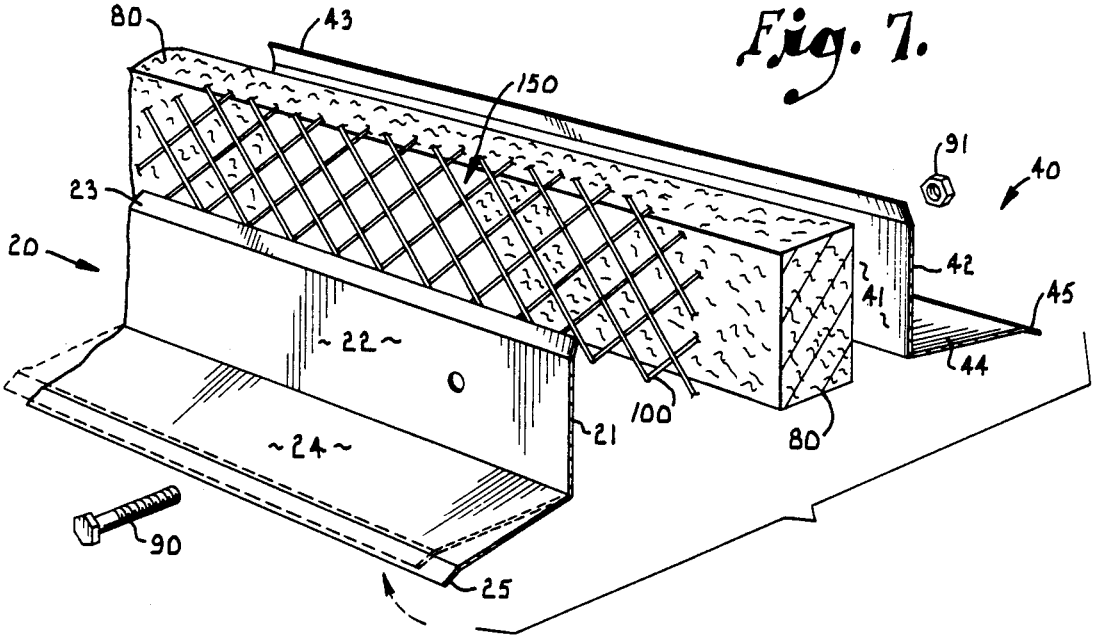
FIG. 7 is an exploded view of the fence protector relative to a section of the fence line.

Turning more particularly to the drawings, FIG. 1 illustrates a straight run of a chain link fence 100 with the fence protector 10 in place. FIG. 7 illustrates a portion of said fence 100 with a portion of the protector 10 being exploded relative thereto. The fence 100 comprises first 102 and second (not shown) end support posts with an intermediate post 106 therebetween. A top support bar 107 horizontally extends between the end posts and atop the intermediate post 106. The fence 106 is illustrated as a chain link-type so as to present a plurality of interstices 150 between the interwoven wires. As such, the ends of the fence 100 are first reinforced with bars 101 which are then secured to the end posts 102 by clamp members 112, 114. Wire 115 attaches portions of the fence 106 to the intermediate post 106 and top bar 107.

The protector 10 comprises first and second panels members 20, 40 which are generally L-shaped in configuration to present generally vertical leg members 22, 42 and horizontal leg members 24, 44. Each leg has beveled portions 23, 43 and 25, 45 at the free ends thereof. An elongated strip 80 of compressible material, cut from an insulation batt, has a height approximating the height of the respective vertical legs 22, 42.

Figure 5:
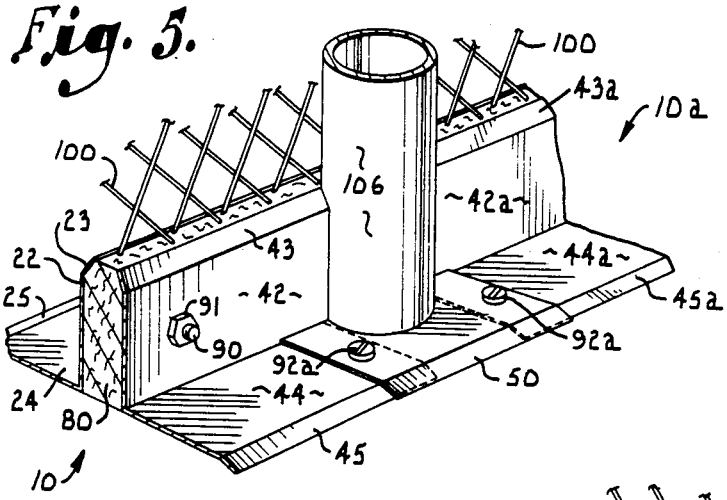
FIG. 5 is a perspective view of the fence protector adapted to fit about an intermediate support post on the fence line.

In use, the interior face 21 of the leg member 22 is placed adjacent one side of the fence 100. The insulation strip 80 is placed on the opposed side of the fence 100 with the interior face 41 of the other vertical leg 42 abutting this insulation strip 80. As shown in FIG. 5, the vertical and horizontal legs 42, 44 of sequential protectors 10, 10a are notched and trimmed with the latter being subsequently overlaid with cover 50 screwed 92a thereto. On the opposed side of fence 100, the horizontal legs 24, 24a of successive protectors 10, 10a are overlapped and connected by screw 92b (FIG. 1). This construction allows the panel 40 to be fitted about intermediate post 106. FIGS. 3 and 4 illustrate the attachment of the protector 10 to a fence corner. As shown in FIG. 3, legs 22, 22' of panels 20, 20' are flush-mounted at the outside corner thereof with the legs 42, 42' of panels 40, 40' at the inside corner (FIG. 4) being notched to fit about the end post 102. A flap 29 cut from leg 22 is folded so as to lie below leg 24'. The overlying horizontal leg 24' is then fastened to fold 29 by sheet metal screw 92'. The overlapping horizontal legs 44, 44' of the panels 40, 40' at the inside corner are connected by screw 92'' (FIG. 4).

A plurality of bolt/nut fasteners 90 horizontally extend through the vertical leg 22, the interstices 150 of the fence 106, insulation strip 80 and the opposed vertical leg 42. Upon tightening the nut 91 thereto, the nut 91 bears against the outside face of the vertical leg 42. This action draws the respective legs 22, 42 of panel members 20, 40 one towards the other until the beveled edges 23, 43 thereof contacts the fence 106. Concurrent with such movement, the interposed insulation material 80 is compressed between the panels 20, 40 and forced through the interstices 150 of the fence 106. Upon contact of the beveled edges 23, 43 with fence 106 the insulation strip 80 contacts the opposing interior face 21 of leg 22 as shown in FIG. 2 so as to fill the channel 32 as presented by the spaced apart leg members 22, 42.

Figure 6:
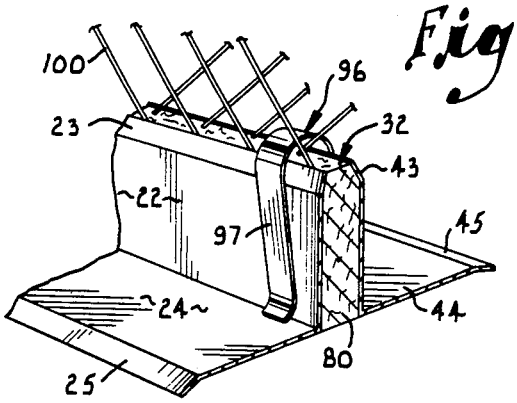
FIG. 6 is a perspective view of the fence protector showing the use of a clamping member for connecting the panels of the fence protector.
Figure 8:
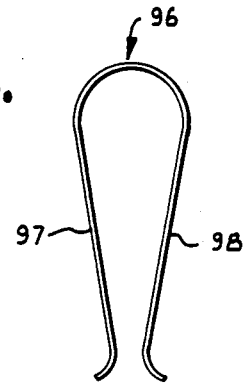
FIG. 8 is a front elevation view of the clamp in FIG. 6.

An alternative fastening device is shown in FIGS. 6, 8 in the form of a clamp 96 which is insertable through an interstice 150. Clamp 96 includes first 97 and second 98 prongs biased one towards the other. Clamp 96 receives the vertical legs 22, 42 therein so that each prong 97, 98 contacts the exterior face of a vertical leg 22, 42. The bias of the prongs 97, 98 is thus transferred to the legs 22, 42 which draws the panels 20, 40 one towards the other and compresses the insulation therebetween. Accordingly, the use of clamp 96 presents the same effect of the bolt/nut combination 90 as above described.

Once the plurality of bolts 90 are tightened, a channel 32 is presented between the opposed panels which contains the bottom free edge of the fence 100. The compressed insulation 80 fills this channel 32 which precludes the entry of sunlight, water, seeds, etc. and subsequent growth of vegetation therein. It is noted that the beveled edges 23, 43 are effective in directing rain and other elements away from the channel 32 so as to inhibit deterioration of the strip 80. This insulation-filled channel 32 cooperates with the ground-contacting leg members 24, 44 to preclude growth of vegetation beneath and along the fence line.

It is noted that the panels 20, 40 may be in continuous lengths or may be of specific precut lengths. With the latter it may be necessary to overlap the panels as shown by 20a and 20 in FIG. 1 and connected by screw 92.

It is to be understood that while certain forms of this invention have been illustrated and described, it is not limited thereto, except in so far as such limitations are included in the following claims.

Having thus described the invention, what is claimed as new and desired to be secured by Letters Patent is:

1. In combination with a fence extending between longitudinally spaced-apart posts, a fence guard comprising:

first and second panel members each having a pair of first legs positioned along opposed sides at the bottom of said fence in a vertical position to form a fence-receiving channel for the fence bottom therein;

a pair of second legs which are disposed to lie on the ground and extend outwardly in opposite directions from said first legs and said fence;

a compressible material for insertion between said fence and a first leg of one of said panel member;

means for drawing said respective first legs one to the other to compress said material therebetween, said compression causing said material to contact the other first leg of said other panel whereby to fill said channel, said material restricting the entry of growth enhancing elements in said channel whereby to restrict said growth of vegetation therein.

2. The apparatus as claimed in claim 1 wherein said compressible material is a strip of insulation inserted between said fence and one of said panel members.

3. The apparatus as claimed in claim 2 wherein said drawing means comprises:

a bolt member extending through said first legs and said fence interposed therebetween; and a nut member functionally engageable with an end of said bolt and bearing against one of said first legs whereupon tightening of said nut about said bolt draws said first legs one towards the other.

4. The apparatus as claimed in claim 2 wherein said drawing means comprises:

a clamping member having first and second prongs biased one towards the other, said first legs insertable between said biased prongs, said prongs contacting an adjacent first leg in a manner to transfer the bias of each prong to said contacting leg whereby to draw said first legs one towards the other.

5. The apparatus as claimed in claim 1 wherein each of said first vertical legs has a beveled edge at the top thereof, said bevel directing said growth enhancing elements away from said channel.

6. In combination with a fence extending between longitudinally spaced-apart posts, a fence guard comprising:

first and second panel members each having a pair of first legs positioned along opposed sides at the bottom of said fence in a vertical position to form a fence-receiving channel with the fence bottom therein;

a compressible material for insertion between said fence and a first leg of one of said panel members;

means for drawing said respective first legs one to the other to compress said material therebetween, said compression causing said material to contact the other first leg of said other panel whereby to fill said channel, said material restricting the entry of growth enhancing elements in said channel whereby to restrict said growth of vegetation therein.

7. For use with a fence guard having first and second panel members positioned on opposed sides of a fence line for forming a channel containing the bottom of said fence line therebetween, the improvement comprising a method of precluding growth of vegetation in said channel comprising the steps of:

(a) positioning said first panel member on one side of said fence line;

(b) positioning a strip of batt insulation on the opposed side of said fence line;

(c) positioning said second panel member on the other side of said fence line adjacent said batt material;

(d) drawing said first panel member towards said second channel to form said channel and compress said insulation therebetween, whereby said insulation fills said channel and inhibits the introduction of growth enhancing elements therein.

* * * * *